US007568329B2

(12) United States Patent
Cranston, III et al.

(10) Patent No.: US 7,568,329 B2
(45) Date of Patent: Aug. 4, 2009

(54) DUAL MODE STRAPPER

(75) Inventors: Albert E. Cranston, III, Oregon City, OR (US); Montgomery Scott Cranston, Clackamas, OR (US)

(73) Assignee: Cranston Diversified Industries, Inc., Oak Grove, OR (US)

( * ) Notice: Subject to any disclaimer, the term of this patent is extended or adjusted under 35 U.S.C. 154(b) by 0 days.

(21) Appl. No.: 11/998,352

(22) Filed: Nov. 28, 2007

(65) Prior Publication Data

US 2008/0083775 A1 Apr. 10, 2008

Related U.S. Application Data

(62) Division of application No. 10/558,775, filed as application No. PCT/US2005/016320 on May 10, 2005, now Pat. No. 7,322,168.

(51) Int. Cl.
*B65B 11/00* (2006.01)
*B65B 13/16* (2006.01)

(52) U.S. Cl. ..... 53/585; 100/9

(58) Field of Classification Search ..... 53/399, 53/439, 530, 580, 582, 585, 589; 100/2, 100/3, 9, 14, 26

See application file for complete search history.

(56) References Cited

U.S. PATENT DOCUMENTS

| | | | |
|---|---|---|---|
| 679,732 | A | 8/1901 | Dederick |
| 2,670,675 | A | 3/1954 | Burkett |
| 3,288,055 | A | 11/1966 | Vellrath |
| 3,393,633 | A | 7/1968 | Hoffman et al. |
| 3,613,556 | A | 10/1971 | Wright et al. |
| 3,964,380 | A | 6/1976 | Meyer et al. |
| 3,996,719 | A | 12/1976 | Dabrowski et al. |
| 4,240,245 | A | 12/1980 | Oosterling et al. |
| 4,312,173 | A | 1/1982 | Killermann |
| 4,936,206 | A | 6/1990 | Miles et al. |
| 5,727,454 | A | 3/1998 | Takikawa |

FOREIGN PATENT DOCUMENTS

WO 93/13989 7/1993

OTHER PUBLICATIONS

U.S. Appl. No. 08/047,664, filed Apr. 15, 1993, Moody.
Harris HHB Horizontal Baler and Badger 2-Ram Bailer (6 pages, retrieved from www2.catalognavigator.com on Nov. 25, 2005.
Cranston Machinery Co. Inc. brochure (2004).
Cranston Machinery Co. Inc. flyer, "1000 Series Wire Strapper" (2004).

*Primary Examiner*—Stephen F Gerrity
(74) *Attorney, Agent, or Firm*—Klarquist Sparkman, LLP

(57) ABSTRACT

A dual mode strapper for strapping an article is illustrated with a strap-forming mechanism capable of selectively operating in a first mode to pre-form an endless pre-formed strap of a predetermined length at least slightly greater than an initial perimeter of the article to be strapped, and in a second mode to apply strapping material directly to the article to be strapped and thereafter form the strapping material into an endless directly applied strap around the article. The strap-forming mechanism defines an opening in which the article is received. The dual mode strapper may also include a pre-formed strap holding area adjacent the strap-forming mechanism that extends at least partially around the opening. When the strap-forming mechanism is operating in the first mode, the pre-formed strap holding area receives the pre-formed strap from the strap-forming mechanism and maintains the pre-formed strap in spaced-apart relation from the article before dispensing the pre-formed strap from the holding area onto the article to be strapped.

11 Claims, 10 Drawing Sheets

DUAL MODE STRAPPER

CROSS REFERENCE TO RELATED APPLICATIONS

This application is a division of U.S. patent application Ser. No. 10/558,775, filed Dec. 1, 2005, now U.S. Pat. No. 7,322,168, which is the U.S. National Stage of International Application No. PCT/US2005/016320, filed May 10, 2005, both of which are incorporated herein by reference.

FIELD

The present application is directed to an apparatus and methods for accumulating and dispensing multiple straps onto articles.

BACKGROUND

Many articles are more conveniently handled if they have encircling straps applied to them, either to hold them together or to provide a means for lifting or transporting them. One example of this is where materials are formed into a bale (or bundle), with straps encircling the bale. The straps are used both for securing the materials in the bale and also to retain the size and desired shape of the bale. Typically, multiple straps are spaced apart along the length of the bale.

Often such bales are produced by equipment which includes large hydraulic presses which press the material into the initial bale shape desired. These bales are discharged from the press and retention straps are formed about the bale to hold it in the desired shape and size. Such strapping often occurs as the bale is being discharged from the press.

One problem with conventional equipment is that it cannot operate with sufficient speed to match the outfeed speed of the materials exiting from the bale press.

Some strapping equipment attempted to solve this problem by accumulating multiple pre-formed endless straps encircling an article-receiving region of the press and then dispensing the pre-formed straps onto the article as it is moved into or through the article-receiving region. The equipment, however, was limited to dispensing only pre-formed endless straps about a bale and could not be used in other ways for different applications, such as to form and apply a strap directly to the bale. In other words, the equipment was not configurable for varying sizes and resiliencies of articles. Also, the equipment did not provide sufficient robustness for long-term operability and did not have a compact arrangement. Furthermore, the equipment did not provide pre-formed straps of sufficient tightness for some applications and, although quicker than strapping directly onto the bundles (which typically requires stopping and starting the press each time), still did not provide sufficient speed for some applications.

Thus, it is seen that a different approach is needed to provide efficient and reliable strapping of bales of various characteristics that allow the press to operate at faster speeds.

SUMMARY

Disclosed below are representative embodiments that are not intended to be limiting in any way. Instead, the present disclosure is directed toward novel and nonobvious features, aspects, and equivalents of the embodiments of the dual mode strapper and methods described below. The disclosed features and aspects of the embodiments can be used alone or in various novel and nonobvious combinations and sub-combinations with one another.

In one embodiment, a dual mode strapper for strapping an article comprises a strap-forming mechanism capable of selectively operating in a first mode to pre-form an endless pre-formed strap of a predetermined length at least slightly greater than an initial perimeter of the article to be strapped, and in a second mode to apply strapping material directly to the article to be strapped and thereafter form the strapping material into an endless directly applied strap around the article. The strap-forming mechanism defines an opening in which the article is received. The dual mode strapper may also include a pre-formed strap holding area adjacent the strap-forming mechanism that extends at least partially around the opening. When the strap-forming mechanism is operating in the first mode, the pre-formed strap holding area receives the pre-formed strap from the strap-forming mechanism and maintains the pre-formed strap in spaced-apart relation from the article before dispensing the pre-formed strap from the holding area onto the article to be strapped. In certain implementations, the article to be strapped when the strap-forming mechanism is operating in the first mode can be a generally expandable article, which is defined to mean an article comprising at least some material that is resilient, i.e., tending to expand or return to its original size after an external compressive force is removed, such that the overall article would tend to expand if not constrained. The article to be strapped when the strap-forming mechanism is operating in the second mode can be a generally non-expandable article, which is defined to mean an article that has a relatively static exterior shape and size after it is released from an external compressive force. Such generally non-expandable articles are said to have little or no regrowth following compression.

In some implementations, the strapper comprises a plurality of dispensers each having a reciprocating portion capable of movement between an accumulating position and a dispensing position. The dispensers may be positioned in the pre-formed strap holding area. The reciprocating portion can include a jaw movably coupled to a yoke where the jaw includes a plurality of holding bays that are capable of maintaining the pre-formed strap in spaced-apart relation. Each dispenser can also include at least one spring positionable at least partially between the jaw and the yoke to apply a biasing force to the jaw to urge the jaw away from the yoke and toward the opening in the strap-forming mechanism. As the jaw moves from the dispensing position to the accumulating position, the pre-formed strap received by the pre-formed strap holding area can urge the jaw to overcome the biasing force of the spring and move outward away from the opening toward the yoke.

In some implementations, the pre-formed strap can be selectively dispensable onto the article as the jaw moves from the accumulating position to the dispensing position. In some implementations, the jaw can include an elongate member having a plurality of tooth-shaped protrusions with the holding bays being defined between adjacent protrusions. The jaw can be movable to shift the pre-formed strap held in the bays sequentially to the end of the jaw to selectively dispense a pre-formed strap therefrom.

In some implementations, the pre-formed strap holding area can include at least one pre-formed strap support member, wherein the pre-formed strap is formed tightly to the support member. The support member can include an elongated recess configured to receive a portion of the reciprocating portion. The support member can include an outer surface with a portion including depressions thereon capable of receiving the pre-formed strap. The outer surface portion can include tooth-shaped protrusions adjacent the depressions that are configured to resist movement of the pre-formed strap in a direction the reciprocating portion travels as the reciprocating portion moves from the dispensing position toward the accumulating position.

In some implementations, the strapper can include a cam system having a drive mechanism coupled to the dispensers for facilitating movement of the reciprocating portion between the accumulating position and the dispensing position. The drive mechanisms can be synchronized. The drive mechanism can be a motor, actuated cylinder, linear actuator, rotary actuator, combination thereof or other similar device. The cam system can include a movable cam rail coupled to the drive mechanism and the reciprocating portion can include a cam system engaging portion for engagement with the movable cam rail such that movement of the cam rail facilitates movement of the reciprocating portion. In specific implementations, a single movable cam rail can be in engagement with at least two of the plurality of dispensers such that movement of the cam rail facilitates concurrent movement of the reciprocating portions of two or more dispensers. In other specific implementations, the movable cam rail can include a diagonally oriented slot formed therein and the cam system engaging portion can comprise a cam follower configured to be positionable within the slot such that movement of the cam rail urges the cam follower to move within the slot.

In some implementations, the plurality of dispensers can be coupled to the frame via a dispenser mount that can include a cam rail slot configured to allow the cam rail to extend therethrough. Each of the plurality of dispensers can include cam rail guides coupled to the dispenser mount proximate the cam rail slot such that the cam rail extends between the cam rail guides. The cam rail guides can provide lateral support for the cam rail. The dispensers can be retractable.

In some implementations, the dual mode strapper can include a frame having an opening defined therein sized at least as large as the article. The strap-forming mechanism can be mounted to the frame and at least a portion of the strap holding area can be mounted to the frame.

The frame can be movable between a first position when the strap-forming mechanism is operating in the first mode and a second position when the strap-forming mechanism is operating in the second mode. The strapper can also include support arms to support the frame as the frame moves between the first position and the second position. The support arms can include a rotatable threaded portion where rotation of the threaded portion facilitates movement of the frame between the first and second positions. Movement of the frame can be induced manually or by a drive mechanism.

In other implementations, the strapper includes swing arms coupled to the dispensers that facilitate movement of the dispensers away from the article when the strap-forming mechanism is operating in the second mode.

In one embodiment, a dispenser for holding and dispensing pre-formed securing strap for securing an article includes a yoke configured to reciprocate between a holding position and a dispensing position. The dispenser also includes a jaw movably coupled to the yoke. The jaw can include a plurality of holding bays configured to hold the pre-formed securing strap about an article-receiving region of the dispenser. The jaw accumulates pre-formed securing strap when the yoke is moved from the dispensing position to the holding position and dispenses pre-formed securing strap onto the article when the yoke is moved from the holding position to the dispensing position. The dispenser can include at least one spring positioned between and in contact with the yoke and jaw where the spring is configured to bias the jaw away from the yoke.

In some implementations, the dispenser includes a driving mechanism coupled to the yoke to move the yoke between the holding position and the dispensing position. The driving mechanism can be a vertically oscillating cam rail engageable with the yoke for facilitating reciprocation of the yoke between the holding position and the dispensing position. The driving mechanism can be a motor, actuated cylinder, linear actuator, rotary actuator or combination thereof.

In other implementations, the dispenser can include an anvil positioned proximate the article-receiving region for at least partially supporting the pre-formed securing strap. The anvil can include an elongate recess into which a portion of the jaw is extendable.

In some implementations, the jaw can comprise an elongate member having a plurality of tooth-shaped protrusions with holding bays defined between adjacent protrusions. The protrusions can comprise a generally concave surface for retaining pre-formed strap in the holding bays as the jaw moves from the holding position to the dispensing position. The generally concave surfaces of the protrusions can retain the pre-formed strap such that, as the jaw moves from the holding position to the dispensing position, the pre-formed strap slides along the anvil. The protrusions can comprise an inclined surface generally opposing the generally concave surface. Contact between the inclined surface and pre-formed securing strap in a first holding bay can urge the jaw to overcome the spring biasing force and move outward relative to the strap and longitudinally beyond the strap as the yoke moves from the dispensing position to the holding position such that the strap is retained in a second holding bay. The jaw can be movable to shift straps held in holding bays sequentially to the end of the jaw to discharge at least one pre-formed strap therefrom.

In one embodiment, bundle equipment includes a machine operable to produce formed bundles of materials having a nozzle through which the formed bundles move and from which the bundles are discharged. The bundle equipment includes a strap-forming mechanism positionable about the nozzle and capable of selectively operating in a first mode to pre-form an endless pre-formed strap of a predetermined length at least slightly greater than an initial perimeter of the article to be strapped, and in a second mode to apply strapping material directly to the article to be strapped and thereafter form the strapping material into an endless directly applied strap around the article. The bundle can also include a pre-formed strap holding area adjacent the strap-forming mechanism and extending at least partially around the nozzle. When the strap-forming mechanism is operating in the first mode, the pre-formed strap holding area receives the pre-formed strap from the strap-forming mechanism and maintains the pre-formed strap in spaced-apart relation from the article before dispensing the pre-formed strap from the holding area onto the article to be strapped.

In some implementations, the bundle equipment can comprise a frame coupled to the nozzle and the strap-forming mechanism and movable between a first position when the strap-forming mechanism is operating in the first mode and a second position when the strap-forming mechanism is operating in the second mode. In other implementations, the formed bundle can be a generally expandable bundle when the strap-forming mechanism is operating in the first mode and the formed bundle can be a generally non-expandable bundle when the strap-forming mechanism is operating in the second mode. The bundle equipment can include swing arms coupled to the pre-formed strap holding area to facilitate movement of at least a portion of the pre-formed strap holding area away from the formed bundle when the strap-forming mechanism is operating in the second mode.

In other implementations, the pre-formed strap holding area can comprise a jaw coupled to a yoke such that the jaw moves with the yoke. The jaw can include a plurality of holding bays that are each operable to hold at least one pre-formed strap. The yoke can be movable parallel to the direction of the formed bundle as it moves through the nozzle and movable between an accumulating position and a dispensing position. The pre-formed strap holding area can include a driving mechanism coupled to the yoke to move the yoke between the holding position and the dispensing position.

The bundle equipment can also comprise anvils coupled to a sidewall of the nozzle proximate an end of the nozzle at which the formed bundles are discharged. The pre-formed strap can be formed tightly around the anvils.

A method for applying strap to an article can comprise operating a strap-forming mechanism in a first mode to pre-form an endless pre-formed strap of predetermined length at least slightly greater than an initial perimeter of the article to be strapped. The method can include operating the strap-forming mechanism in a second mode to apply strapping material directly to the article to be strapped and thereafter form the strapping material into an endless directly applied strap around the article. The method can also include receiving the pre-formed strap in a pre-formed strap holding area when the strap-forming mechanism is operating in the first mode and maintaining the pre-formed strap in spaced-apart relation from the article when the strap-forming mechanism is operating in the first mode. The method can also include dispensing the pre-formed strap from the holding area onto the article to be strapped when the strap-forming mechanism is operating in the first mode. In some implementations, dispensing the pre-formed strap can comprise dispensing the strap sequentially onto longitudinally spaced locations of the article.

In other implementations, the method can include forming a pre-selected quantity of generally expandable materials into an article. In these implementations, dispensing can comprise dispensing the pre-formed strap from the holding area onto the article of generally expandable materials.

In still other implementations, the method can include firming a pre-selected quantity of generally non-expandable materials into an article. In these implementations, operating the strap-forming mechanism in the second mode can comprise applying strapping material directly to the article of generally non-expandable materials and thereafter form the strapping material into an endless directly applied strap around the article of generally non-expandable materials.

The foregoing and other objects, features, and advantages of the invention will become more apparent from the following detailed description, which proceeds with reference to the accompanying figures.

DETAILED DESCRIPTION

Described below are embodiments of a strapper for applying strapping material to an article. In some embodiments, the strapper can operate in two modes. Generally, when an article of a first type is to be strapped, the strapper can operate in a first mode to pre-form multiple endless straps as the article is being formed, e.g., in a press, and dispense the pre-formed straps onto the moving article as it exits the press. Desirably, the strapping can thus be completed without slowing the throughput of the press. When an article of a second type is to be strapped, the strapper can be switched to a second mode to form endless straps directly around a stopped article as it exits the press.

Figure 1:
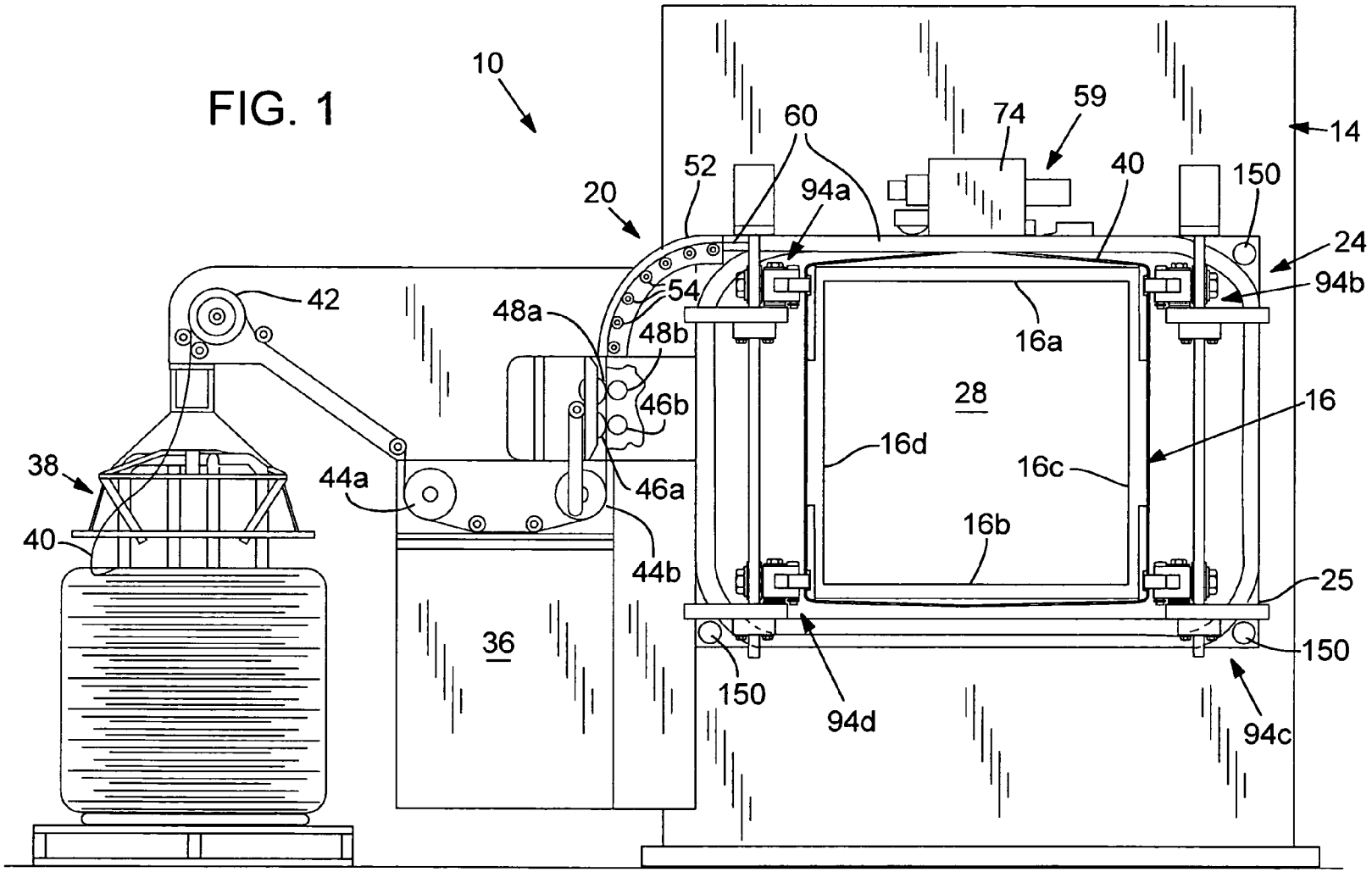
FIG. 1 is a front elevation view of a baling and strapping system showing a strapper constructed according to one embodiment positioned to receive a bale as it exits a discharge nozzle.

Referring to FIG. 1, according to an embodiment of the present application, a baling and strapping system is indicated generally at 10. The system 10 is operable to produce articles, such as a bundle, or bale, of one or more materials, and subsequently to apply a plurality of straps to each bale. The strapping system 10 shown includes an article-producing machine, such as bale-producing machine 14, which has a bale discharge chute, or nozzle 16, strap-driving mechanism 20, and strapper indicated generally at 24.

The bale-producing machine 14 is shown only schematically in the drawings. This machine may be of a type which has a hopper for receiving loose materials to be formed into a bundle, such as waste cardboard, old newspaper, aluminum cans, plastic or metal scraps, and various other materials. It includes one or more hydraulic presses which press against the opposite sides and the top and bottom of material fed from the hopper into the area of the presses to compress the material into a selected bundle shape. A bale-producing machine which is capable of such operation is commonly referred to in the industry as a horizontal two ram solid waste press.

A conveyor mechanism in the machine 14 is operable to force a formed bundle of material outwardly through nozzle, or chute, 16. The path of a bundle progressing through the machine is indicated generally in dashed outline at 26 in FIG. 3 and as an emerging bundle at 32. A bundle 32, or article, being forced outwardly through chute 16 is shown in FIGS. 3, 4, 6-8 and 10 with the direction of movement of bundle, or article, 32 indicated by arrow 34.

The discharge chute, or nozzle 16, has a top plate 16*a*, an opposed bottom plate 16*b* and opposed upright side plates 16*c*, 16*d*, which together define a substantially rectangular bundle-receiving, or article-receiving, region 28.

The machine 14 may also be of a type that will produce stacks of material, such as stacks of lumber or veneer, or any other type of article about which straps may be placed for securing, transporting and/or lifting the article thus produced.

With reference to FIG. 1, strap-driving mechanism 20 now will be described in greater detail. It includes a coil support 38 which, in the illustrated embodiment, supports a coil of strapping. "Strapping" as used herein comprises any material of sufficient strength and flexibility to be wrapped around a bundle and secured, usually in a loop, to form a strap, and typically having a relatively small cross section compared to its length. Such strapping includes, but is not limited to, wire, tape, flat strap, oval strap, round strap, whether metallic or made of other materials, or string. When using wire as strapping, it can be a heavy metal wire such as 8-13 gauge wire having a diameter of approximately 0.125 inches and a high tensile strength ranging from approximately 160,000 psi to approximately 230,000 psi. An exemplary heavy metal wire is indicated at 40.

A portion of the wire extends from the coil, over a roller 42, down and under a pair of spaced rollers 44*a*, 44*b*, and up through two opposed pairs of drive rollers 46*a*, 46*b* and 48*a*, 48*b*. These opposed pairs of rollers are rotated under power to draw wire from the coil, and force it upwardly into an arcuate guide channel 52, with a plurality of rollers 54 supporting the underside of the wire in channel 52.

Rollers 44*a*, 44*b* are mounted above a slack wire receiver envelope 36. This is primarily a pair of parallel upright plates spaced apart by a distance slightly greater than the width of wire 40 and having an open top. During the process of producing a strap, as will be described in greater detail below, a quantity of slack wire material is produced and can be received loosely in the slack wire receiver envelope to prevent such from becoming tangled until the wire again is tightened.

Figure 4:
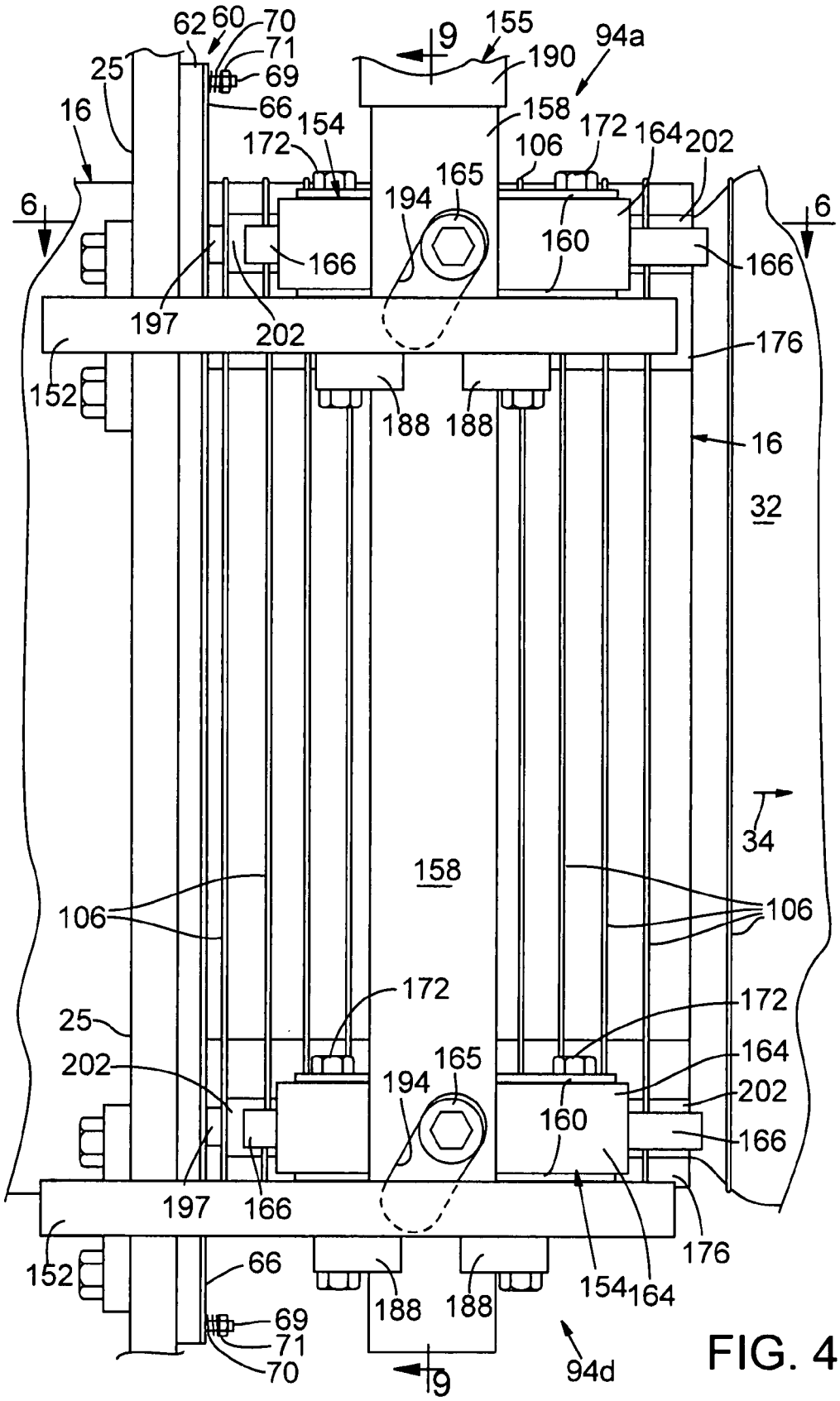
FIG. 4 is a side view of the strapper of FIG. 1 taken along the line 4-4 in FIG. 3 showing an emerging bale at the right side of the figure.
Figure 5:
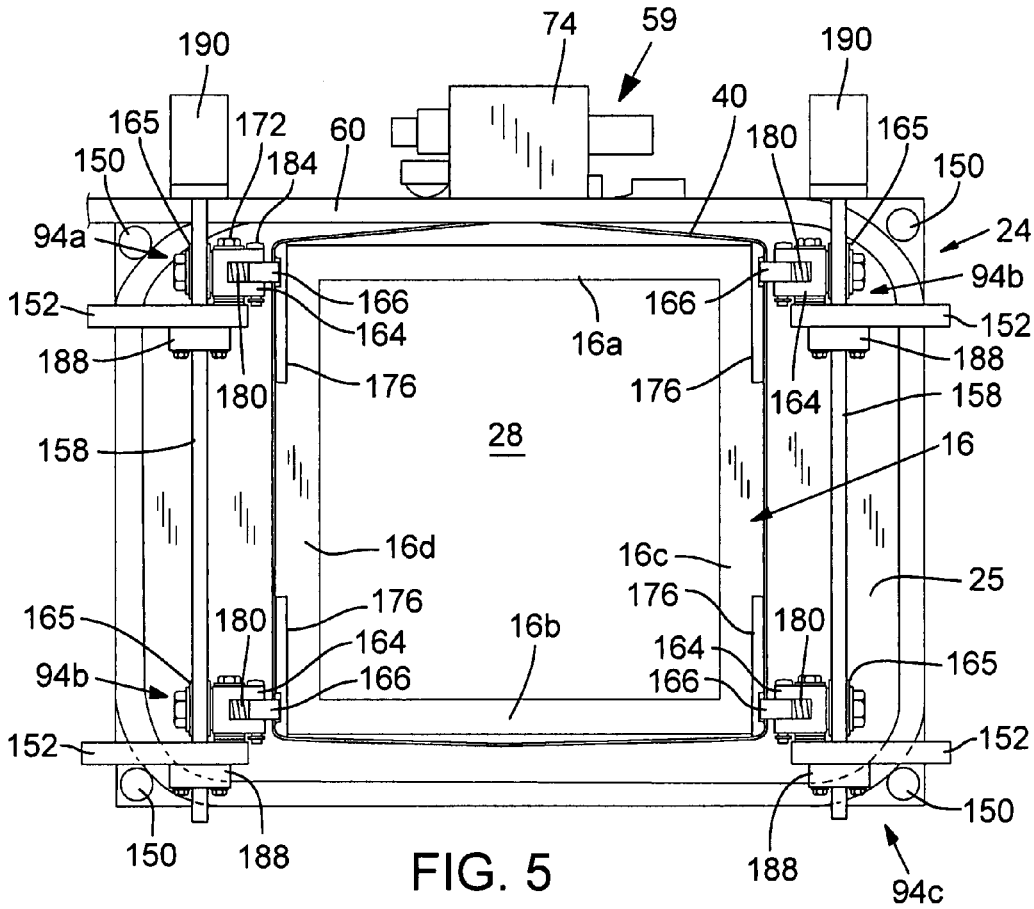
FIG. 5 is an enlarged front elevation view of the strapper of FIG. 1.

The wire is forced by drive rollers 46*a*, 46*b* and 48*a*, 48*b* into a strap-forming portion of the strapper 24 indicated generally at 59. The strap-forming portion 59 includes a strapper guide track 60 which encircles bundle chute 16 and is attached to a strapper frame 25. As used herein, a first object "encircles" a second object by passing completely around or surrounding the second object and does not require the first object to be in contact with, contiguous with or pressed tightly against the second object. The guide track 60 has a configuration as illustrated in FIGS. 1 and 4, and shown in cross-section in FIGS. 6-8. The guide track 60 has a channel section 62 with a guide channel 64 in which wire 40 may travel. A cover plate 66 rests against the open side of channel section 62 and is releasably held against the channel section by bolts 71 and rubber bushings, or spring-type elements 70. The lower edge of channel 64 is slightly chamfered. The cover plate 66 is held against the guide track 60 such that a force applied against the wire 40 to move it inwardly toward the chute 16 allows the wire to release from the channel 64 to encircle the chute. This will be described in greater detail below.

Figure 3:
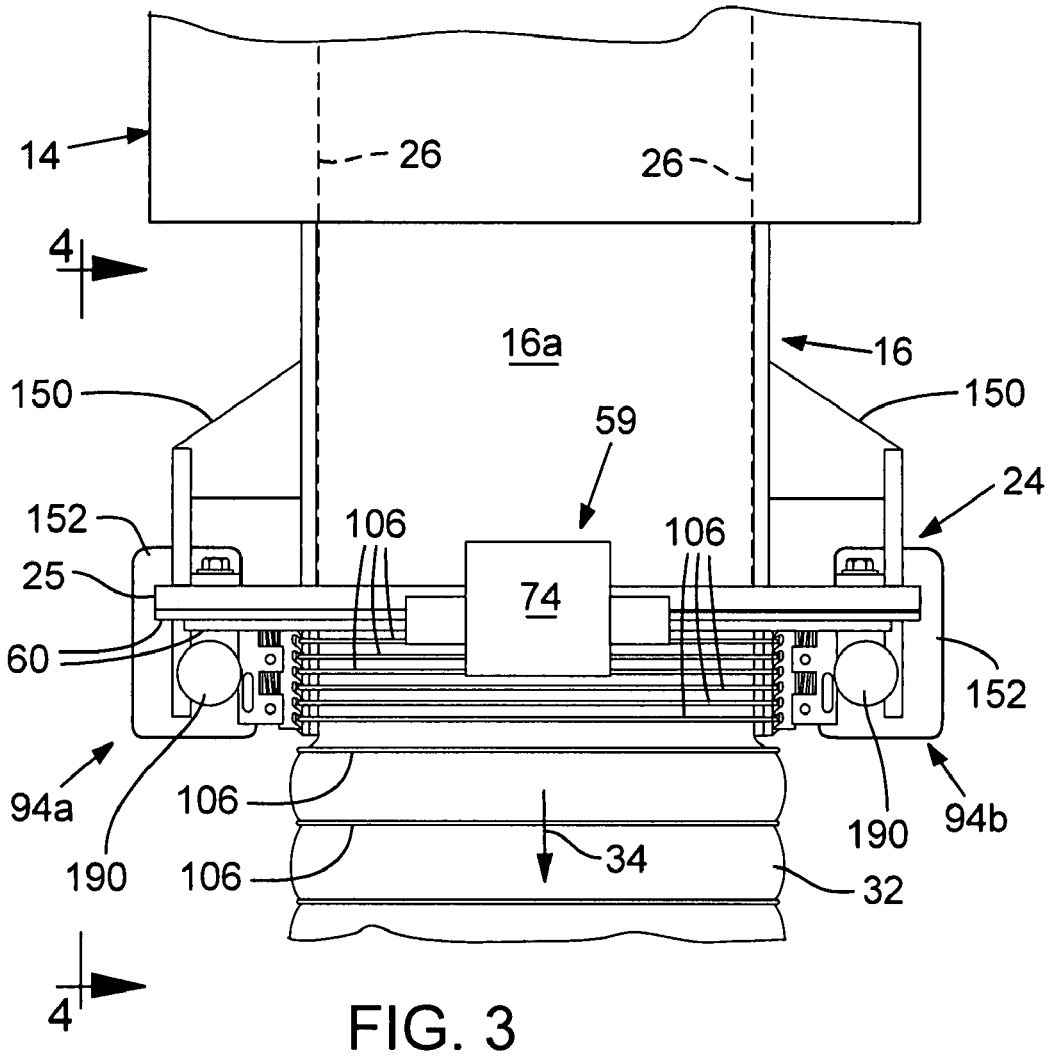
FIG. 3 is a top plan view of a portion of FIG. 1 showing the strapper and an emerging bale onto which straps have been applied.
Figure 10:
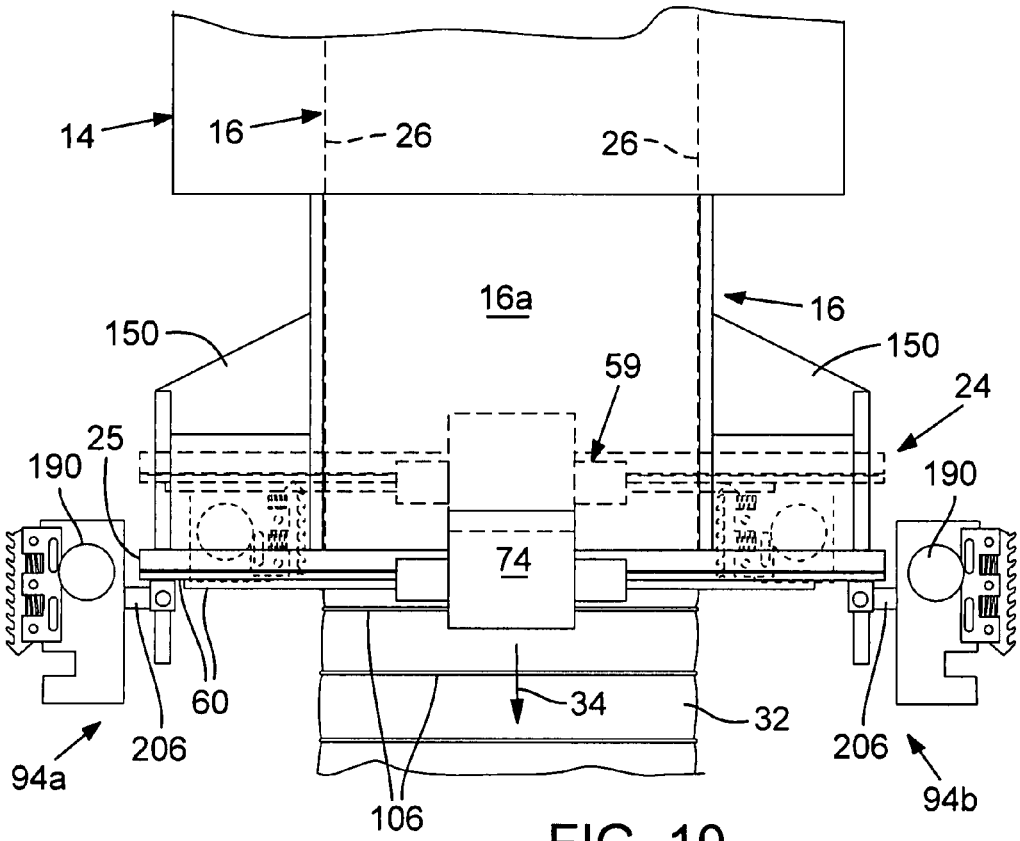
FIG. 10 is a top plan view of a strapper with retractable dispensers shown in their retracted state.

The strapper frame 25 comprises a generally rectangular plate having a through opening 27 (see FIGS. 6-8) sized slightly larger than the nozzle 16 such that the frame can be positioned beyond the end of the nozzle or at points along the nozzle. The major surfaces of the strapper frame 25 extend perpendicular to the top and bottom plates 16*a*, 16*b* of the nozzle 16. The strapper frame 25 can be coupled to the nozzle 16 via support arms 150 as indicated in FIGS. 3 and 10.

The strap-forming portion 59 includes a strap connector unit 74 mounted to the guide track 60. In one embodiment, the connector unit 74 could be a Model 60F001 Fuselok unit manufactured and sold by Cranston Machinery Co., Inc., of Oak Grove, Oreg. Alternatively, it could be a Model 60A064 Strapper or a Model 70B002 Paper Strapper, also from Cranston Machinery Co., Inc.

Describing the operation of the strap-driving mechanism 20, the wire 40, or other strapping, which has sufficient rigidity to be pushed around guide track 60, is fed from the coil, about rollers 42, 44*a*, 44*b* and into the nips between drive roller pairs 46*a*, 46*b* and 48*a*, 48*b*. Powered driving of these rollers serves to push the wire up into guide channel 52 and onwardly into the guide track 60 of the strap-forming portion 59.

During operation of the strap-forming portion 59, as the wire 40 is forced further through guide track 60, it follows a path completely encircling chute 16 until its outer end reaches strap end connector unit 74. The strap end connector unit 74 grasps and holds the end of the strapping wire 40. Drive rollers 46*a*, 46*b* and 48*a*, 48*b* then are reversed in their operation to draw remainder portions of the wire 40 in guide track 60 back toward rollers 44*a*, 44*b*. As the wire 40 is drawn back it is released from guide track 60 by moving into the chamfered portion of the guide track 60, and the force of the wire being drawn back is sufficient to release plates 66 against rubber bushings 70 to allow the strapping wire 40 to be stripped from the guide track to encircle chute 16. Slack wire produced by this reversal and withdrawing of the wire 40 will be received for temporary storage in slack wire receiver 36 under rolls 44*a*, 44*b*.

Generally, in some units, the straps are formed by shearing the wire 40 so that there will be two mating ends and an electrical current is applied to fuse them together into a welded joint to produce an endless strap. In other units, the wire 40 is sheared and an endless strap is produced by twisting opposite end portions of the wire around each other to form a knot.

Figure 2:
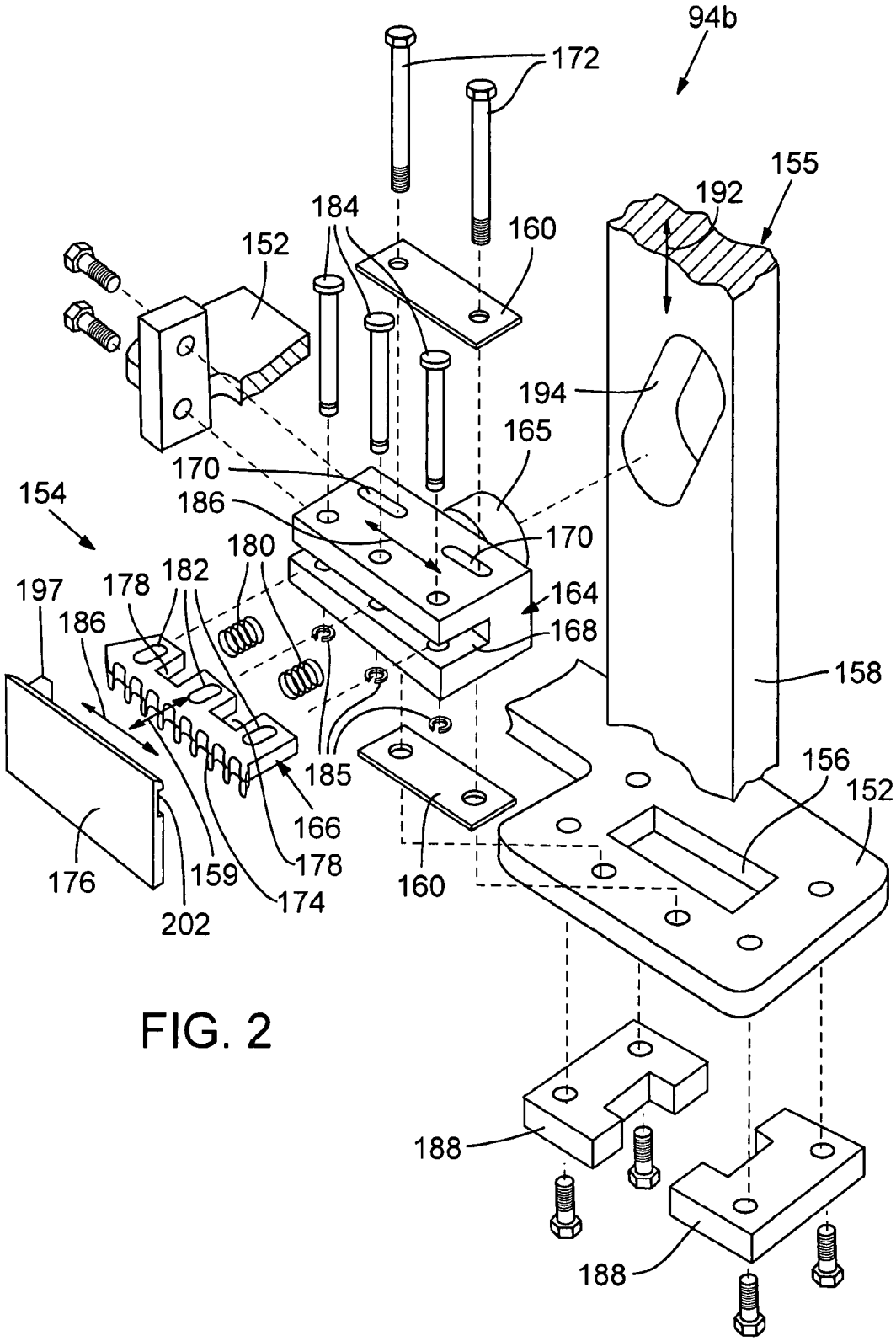
FIG. 2 is an exploded perspective view of one of the dispensers positioned at the corners of the strapper of FIG. 1.

Embodiments of the dual mode strapper with the strapper operating in the first mode to pre-form straps and dispense the pre-formed straps about an article will now be described in greater detail. As shown in FIG. 1, according to some embodiments, the strapper 24 includes dispensers 94*a*, 94*b*, 94*c*, 94*d* coupled to the strapper frame 25. In FIG. 1, the dispensers are positioned generally near the corners of the chute 16 as shown, but in other embodiments, a different number of dispensers can be used and/or the dispensers can be positioned differently. Referring to FIG. 2, which is an exploded view of one of the dispensers shown in FIG. 1, dispenser 94*b* comprises a mount 152, accumulating and dispensing mechanism 154 and cam system 155.

As shown in FIGS. 2-4 and 6-8, dispensers can be coupled to the strapper frame 25 via mount 152. The mount 152 generally includes a cam system receiving portion for receiving at least a portion of the cam system 155 and an accumulating and dispensing mechanism receiving portion for receiving at least a portion of the accumulating and dispensing mechanism 154. In the illustrated embodiment shown in FIG. 2, the cam system receiving portion includes a slot 156 configured to allow a cam rail 158 of the cam system 155 to extend through. The accumulating and dispensing mechanism receiving portion includes plates 160 and fasteners 162 for retaining the mechanism 154 to the mount 152.

The accumulating and dispensing mechanism 154 comprises a yoke 164 and jaw 166. The yoke 164 includes a jaw receiving groove 168 configured to receive a portion of the jaw 166 and a cam system engaging portion, such as cam follower 165, that is configured to operatively engage the cam system. The yoke 164 can be positioned on the mount between plates 160 and include elongated mounting slots 170 configured to receive fasteners 172. The pins 172 extend through the plates 160, the mounting slots 170 and into the mount 152 to movably secure the yoke to the mount.

The jaw 166 includes a toothed portion 174 positionable to project beyond the jaw receiving groove 168. The toothed portion 174 can have a plurality of aligned, similarly shaped teeth 196*a*-196*i* with openings, such as holding bays 198*a*-198*i*, defined generally between the teeth that receive and move pre-formed wires (see FIGS. 6 and 8). The jaw 166 is configured to slidably move adjacent to an anvil 176 that is fixedly attached to the sidewall of the nozzle 16.

The anvil 176 can be made from a durable hardened metal alloy, such as D-2 tool steel, and can be removably attached to the nozzle 16 using a fastener, such as a nut and bolt combination. As illustrated, the anvil 176 can be inset into a recess formed in the sidewall of the nozzle 16 such that at least a portion of the outer surface of the anvil is approximately flush with the outer surface of the sidewall. Although not shown, in some embodiments, the anvil 176 can have a slightly tapered outer surface to facilitate movement of pre-formed straps 106 along the anvil.

The portion of the jaw 166 positionable within the jaw receiving groove 168 includes spring receiving portions 178 configured to receive springs 180. The springs 180 engage the jaw receiving groove 168 of the yoke 164 at one end and the spring receiving portions 178 of the jaw 166 at an opposite end to bias the jaw 166 away from the yoke 164 toward the nozzle 16 such that the jaw 166 engages the anvil 176. The jaw 166 includes slots 182 configured to receive fasteners, or pins 184, for retaining at least a portion of the jaw within the jaw receiving groove 168 and facilitating movement of the jaw relative to the yoke 164 in directions indicated by directional arrow 159. The jaw 166 is coupled to the yoke 164 by extending the pins 184 through holes in the yoke 164 that are alignable with the slots 182, extending the pins through the slots, and securing the pins to the mount 152. As shown in FIG. 2, the pins 184 can have snap-ring grooves and can be securable to the mount 152 by coupling snap-rings 185 to the grooves.

The cam system engaging portion, e.g., cam follower 165, is configured to engage the cam system 155 to facilitate laterally reciprocating movement of the yoke 164 in the directions indicated by arrow 186 in FIG. 2, i.e., parallel to the direction of movement of the bundle 32 as it passes through the chute 16, i.e., arrow 34. Generally, the yoke 164 reciprocates between a first position, or dispensing position, and a second position, or holding position.

In the illustrated embodiments, the cam system 155 includes the cam rail 158, cam rail guides 188 and a driver 190. The cam rail 158 is attached to the driver 190 and extends through the slot 156 formed in the mount 152. The driver 190 is configured to vertically raise and lower the cam rail 158 as indicated by arrow 192. The cam follower 165 of the yoke 154 can be generally circular and configured to extend into a diagonally oriented slot 194 angled with respect to the vertical and horizontal directions. The slot 194 has a width just larger than a diameter of the cam follower 165. In one specific example, a vertical distance between a central axis of the cam follower 165 when it is in the first position and the central axis of the cam follower when it is in the second position is approximately five times the horizontal distance between the central axis of the cam follower when it is in the first position and the central axis of the cam follower when it is in the second position. Cam guides 188 having a notch sized to correspond with at least a portion of the cam rail 158 can be attached to the mount 152 to provide additional directional support for the cam rail 158.

In the illustrated embodiments, the cam systems 155 of dispensers 94*b* and 94*c*, and the cam systems 155 of dispensers 94*a* and 94*d* , share a common cam rail 158 that extends between dispensers 94*b* and 94*c* , and dispensers 94*a* and 94*d* , respectively. Each cam rail 158 is attached to a single driver to vertically raise and lower the cam rail and includes two diagonally oriented slots 194 where the cam follower 165 of the two dispensers sharing the common cam rail 158 engages one of the respective slots such that one driver simultaneously drives two dispensers.

In some embodiments, the driver can be a motor, such as an air, hydraulic electric or magnetic motor, or rotary actuator, such as a hydraulic, magnetic or electric rotary actuator. In specific embodiments, the driver can be a linear actuator, such as a hydraulic, magnetic or electric linear actuator.

In certain embodiments of the cam systems 155 where two dispensers share a common cam rail 158, the driver can include a motor or rotary actuator attached to a connecting rod that is coupled to the two cam rails 158 via a gear mechanism. Operation of the motor or rotary actuator rotates the connecting rod which translates into synchronized vertical raising or lowering of the cam rails and driving of the dispensers in a manner similar to that described in relation to the cam system 155 shown in FIG. 2.

In some embodiments, the cam system 155 of each dispenser is driven by a driver coupled to a driver receiving portion of the yoke to directly drive the dispenser without a cam rail, a cam follower or cam rail guides. In some embodiments, the driver can be attached to the mount 152 or directly to the strapper frame 25. The driver in these embodiments can be an actuated cylinder, a motor, rotary actuator and/or any other driving devices. Moreover, the driver can be hydraulic, electric, magnetic or air driven. In specific embodiments, the driver is a hydraulic cylinder and the driver receiving portion is a tab with an opening therein configured to receive the actuated cylinder. In other specific embodiments, the driver is a motor with a screw drive and the driver receiving portion is a tab with a threaded opening therein configured to receive a rotating screw of the drive. In yet other specific embodiments, the driver is a rotary actuator and the driver receiving portion is a cam.

As is best seen in FIG. 10, when moderately compressible materials having little regrowth following compression, such as metal scrap and recycled aluminum cans, have been pressed together to form a bale 33 in machine 14, and exit from the downstream end of chute 16 in the direction of arrow 34, the bale typically tends to expand only slightly beyond the initial shape it had as it moved through the nozzle 16. Therefore, with bales similar to bale 33, i.e., non-expandable bales, in order to wrap a strap relatively tight around the bale, the usual operation of the strap-forming portion 59 generally necessitates that the strap be formed directly around the bale to be strapped. In other words, the wire 40 is tightened by reverse driving of drive rollers 46*a*, 46*b* and 48*a*, 48*b*, as described above, until the wire is wrapped tightly around bale, or article, 33. The end connector unit 74 would then operate to connect opposite ends of the wire 40 to form an endless strap around the bale 33 to hold the bale in a desired shape and size.

Forming straps directly around the bale typically requires the extruding bundle to be stopped while the strap is formed. Movement of the bundle is then restarted and the bundle continues to extrude until another strap is desired to be formed directly around the bundle and the bundle is stopped for forming a new strap.

Strapping non-expandable bales, as described above, also requires generally that the strap forming portion 59 be positioned such that the guide track 60 holding wire 40 to be formed into a strap around a non-expandable bale overlies the portion of the bale to be strapped, such as shown in FIG. 10. Typically, the portion of the bale to be strapped is a portion of the bale just exiting the nozzle 16 and therefore, the strapper 24 should be positioned proximate the exiting end of nozzle 16.

As is best seen in FIG. 3, when highly compressible materials with appreciable regrowth following compression, such as cardboard, natural and manmade fibers, and loose plastic, have been pressed together to form bale 32, i.e., expandable bale, in bundle-producing machine 14, and exit from the downstream end of chute 16, it has a tendency to expand somewhat beyond the initial shape which it had in the bundle-producing machine and chute 16. Because expandable bales have a tendency to expand, the straps do not need to be formed directly around the article to ensure that the straps are relatively tight against the article. Straps can be initially loose around the article and as the article expands the straps will tighten against the article to hold the article in a desired shape. Accordingly, straps can be pre-formed and accumulated in advance of application of the straps to the article, which can allow faster throughput than a direct strapping operation.

Strapping expandable bales with pre-formed straps typically requires the straps to be applied around a portion of the bale to be strapped prior to significant expansion of the bale. Because expandable bales tend to expand just after exiting the nozzle, the portion of the bale to be strapped, as with non-expandable bale strapping, should be the portion of the bale just exiting the nozzle 16, therefore, the strapper 24 should be positioned such that the pre-formed straps can be applied to the bale as it exits the nozzle 16. As will be described in more detail below, in some embodiments of the strapper 24, the strap forming portion 59 is positioned such that the guide track 60 holding wire 40 to be formed into a pre-formed strap overlies a portion of the nozzle 16 upstream of the downstream end of the nozzle 16. In this way, pre-formed straps can be efficiently accumulated and dispensed around expandable bales as they exit the nozzle 16.

Figure 6:
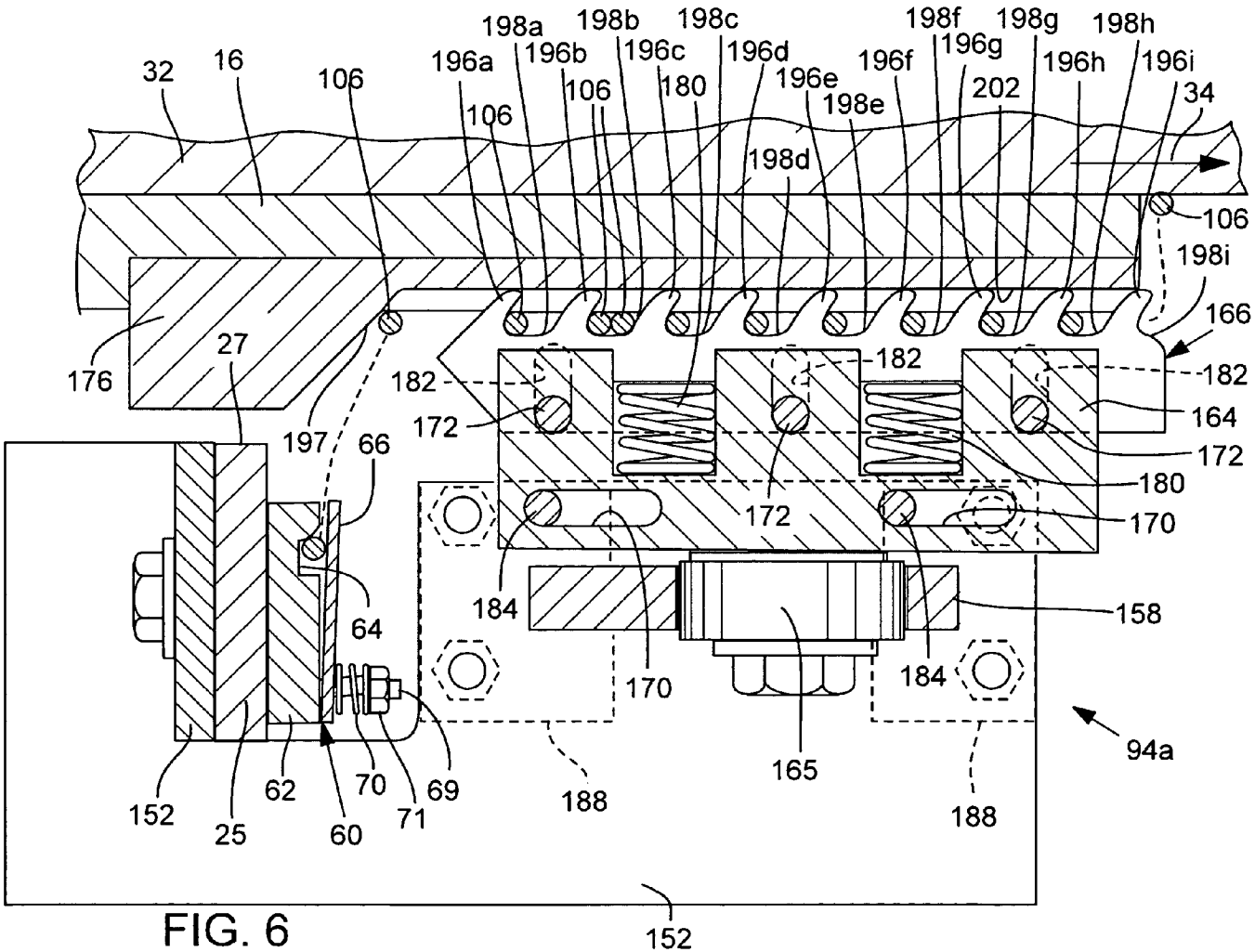
FIG. 6 is a cross-sectional top view of one of the dispensers positioned at the corners of the strapper of FIG. 1 taken along the line 6-6 in FIG. 4 with an accumulating and dispensing mechanism in a dispensing position.
Figure 7:
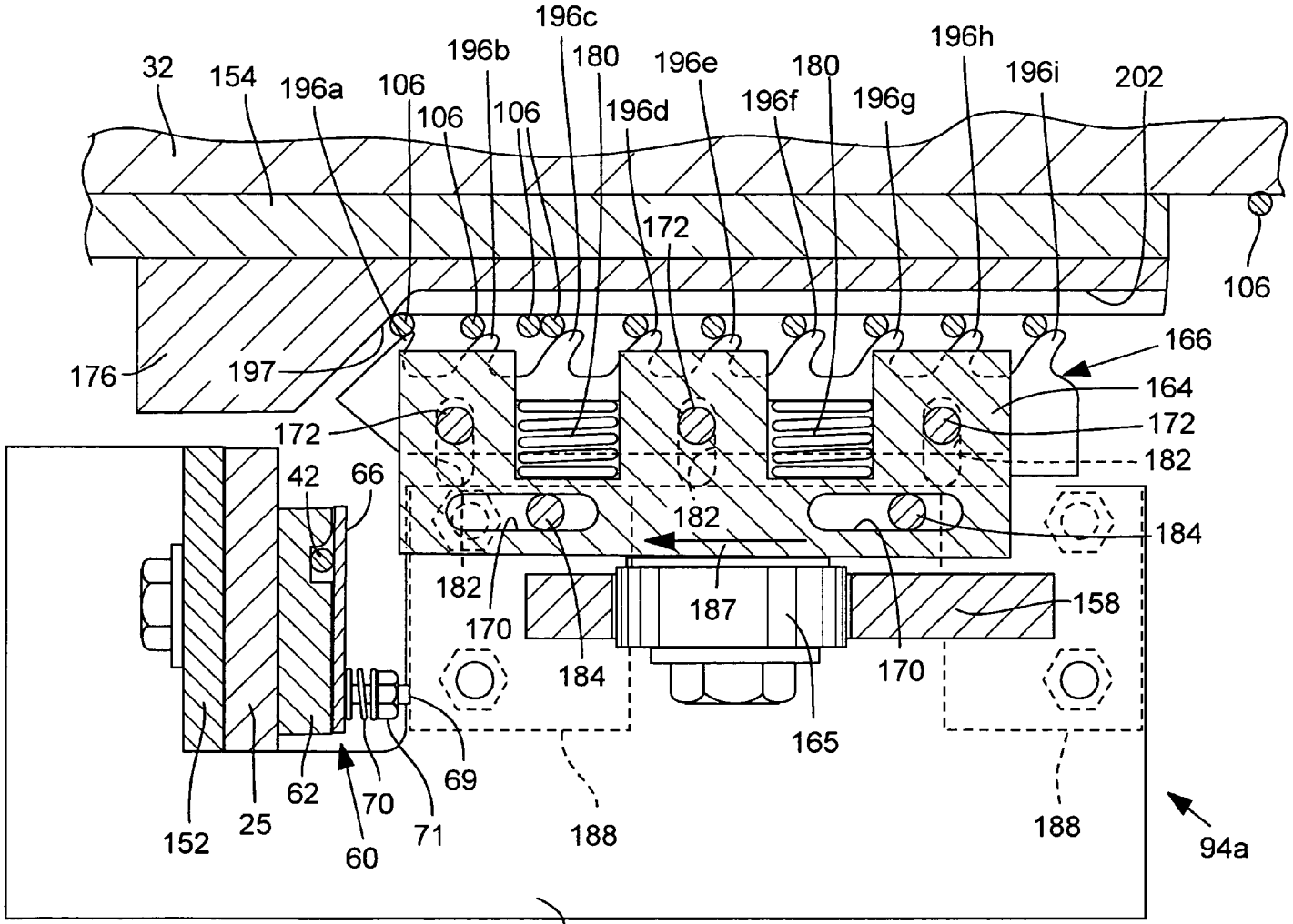
FIG. 7 is the same view of the dispenser as shown in FIG. 6 but with the accumulating and dispensing mechanism in a position between the dispensing and holding positions as the jaw and yoke of the accumulating and dispensing mechanism move from the dispensing position to the holding position.
Figure 8:
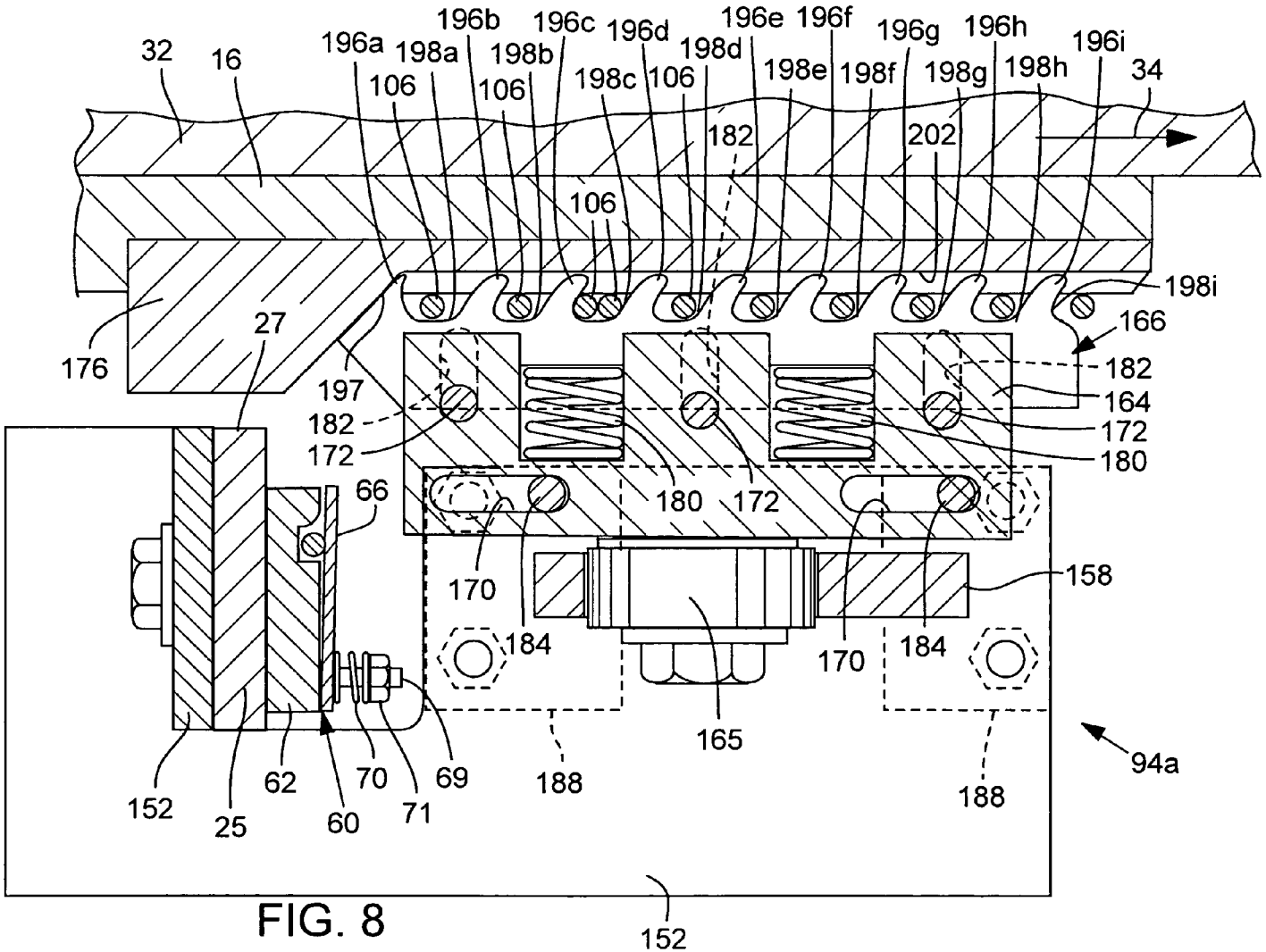
FIG. 8 is the same view of the dispenser as shown in FIG. 6 but with the accumulating and dispensing mechanism in the holding position.
Figure 9:
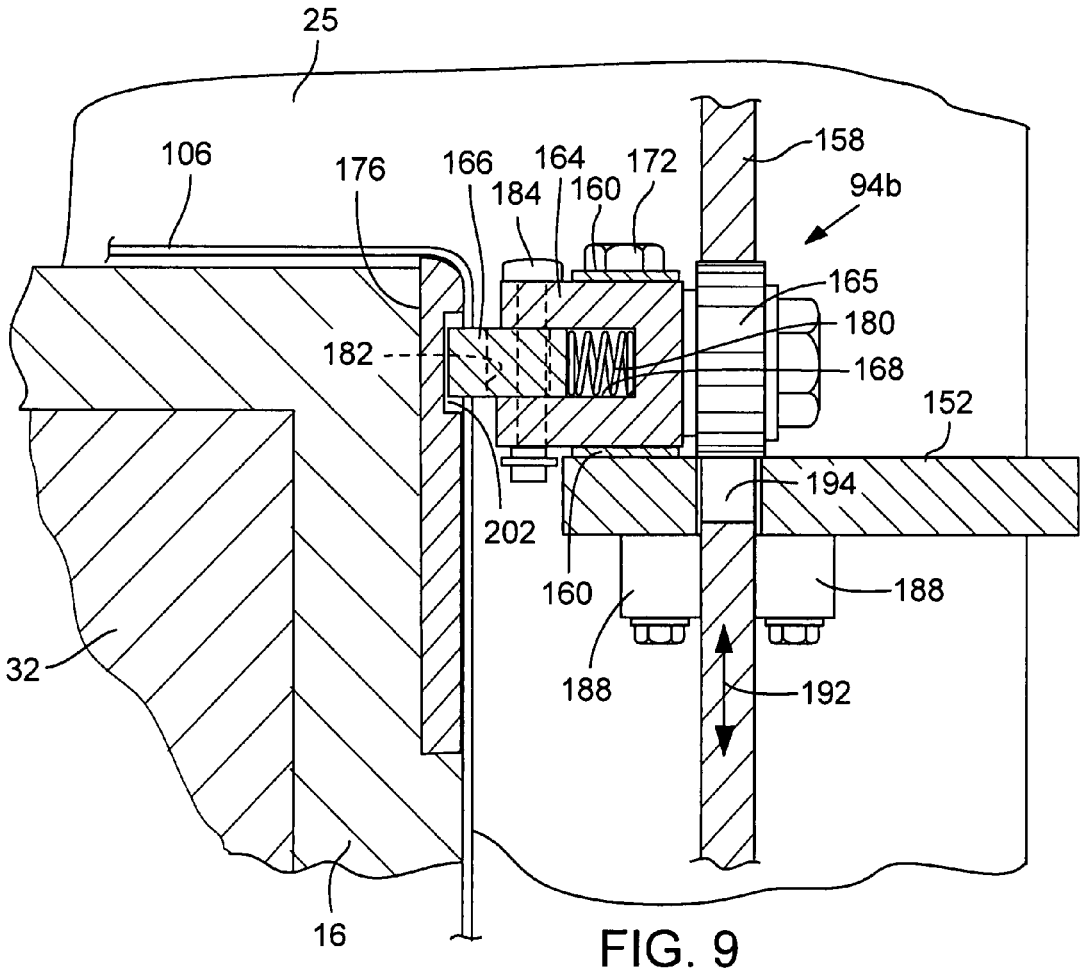
FIG. 9 is a cross-sectional front view of one of the dispensers positioned at the corners of the strapper of FIG. 1 taken along the line 9-9 in FIG. 4.

As best shown in FIGS. 6-8, when strapping expandable bales, guide track 60 holding wire 40 to be formed into a pre-formed strap overlies a strap holding area 197 of the respective anvils 176. The strap-forming unit 59 initiates pre-forming of the straps by tightening the wire 40 around the strap holding areas 197 by the reverse driving of drive rollers 46*a*, 46*b* and 48*a*, 48*b*, as described above, until the wire is wrapped around the nozzle 16 and tightened, to a selected degree, against the strap holding areas 197 of the respective anvils 176 positioned on the sidewalls of the nozzle proximate the four corners of the nozzle 16 (see FIG. 1). In some embodiments, the strap-holding area includes an elevated angled surface on which the holding wire 40 slides down as the wire is tightened to the anvil until the wire is positioned at the base of the angled surface. The end connector unit 74 then connects opposite ends of the wire to form a pre-formed endless strap tightly around the strap holding area 197 of the anvils at the base of the angled surfaces.

The dispensers 94*a*, 94*b*, 94*c*, 94*d* serve to accumulate and dispense the pre-formed straps formed around the nozzle 16. Explaining the operation of the dispensers 94*a*, 94*b*, 94*c*, 94*d* thus far described, it will be seen in FIGS. 6-8 that dispenser 94*a*, being exemplary of the dispensers of the current embodiment, accumulates pre-formed straps by moving the yoke 164 and jaw 166 in a reciprocating motion between the first position, or dispensing position, as shown in FIG. 7, and the second position, or holding position, as shown in FIG. 8. As the yoke 164 moves from the dispensing position to the holding position, in a direction indicated by arrow 187, the jaw 166, being coupled to the yoke, correspondingly moves such that an angled upstream surface of the first tooth 196*a* of the jaw 166 contacts a first-produced pre-formed strap, i.e., a pre-formed strap 106, held tightly against the anvil 176 around the strap-holding area 197 of the anvil. As used herein, "strap" refers to an endless strap or loop and can refer to more than one strap, i.e., straps.

Further movement of the yoke 164 and jaw 166 from the dispensing position towards the holding position results in the strap 106 urging the jaw to overcome the biasing force of the springs 180 to move the jaw upward and over the first-produced pre-formed strap.

The yoke 164 and jaw 166 move into the holding position when the first tooth 196*a* passes the first-produced pre-formed strap and the biasing force of the springs 180 urges the tooth to move downwardly on the other side of the strap. In the holding position, the first-produced pre-formed strap is positioned within a first holding bay 198*a* defined as a space between a downstream surface of the first tooth 196*a* and the angled upstream surface of a second tooth 196*b*.

The yoke 164 and the jaw 166 are then moved from the holding position back to the dispensing position. As the jaw is moved from the holding position toward the dispensing position, the downstream surface of the first tooth 196*a* contacts and retains the first-produced pre-formed strap within the first holding bay 198*a* to urge the strap to slide along the anvil 176 from the strap-holding area 197 to a location downstream of the strap holding area. In the illustrated embodiments, the downstream surfaces of the teeth 196*a*-196*i* are slightly concaved to facilitate holding and retaining the pre-formed straps 106. Generally, the downstream surfaces of the teeth 196*a*-196*i* can be any shape configured to retain pre-formed straps within the holding bays 198*a*-198*i* as the jaw moves from the holding position to the dispensing position.

After the jaw reciprocates from the holding position towards the dispensing position, the strap-forming unit 59 can form a second-produced pre-formed strap around the nozzle 16 on the strap holding areas 197 of the respective anvils 176 as described above.

Once the second-produced pre-formed strap is formed and the yoke 164 and jaw 166 have moved to the dispensing position, the yoke and jaw are reciprocated back towards the holding position. As described above, the first tooth 196*a* moves up, over and around the second-produced pre-formed strap to capture it within the first holding bay 198*a*. Concurrently, the second tooth 196*b* with a second upstream angled surface adjacent the first tooth 196*a* moves up, over and around the first-produced pre-formed strap to capture it within a second holding bay 198*b* defined as a space between the downstream surface of the second tooth and an upstream angled surface of a third tooth 196*c*. The yoke 164 and jaw 166 are then moved from the holding position back to the dispensing position and the first-produced pre-formed strap and the second-produced pre-formed strap, being retained within the first and second holding bays 198*a*, 198*b*, respectively, slide along the anvil 176 such that the first pre-formed strap is relocated downstream of its prior position and the second pre-formed strap is relocated downstream of the strap holding area 197 of the anvil 176.

The reciprocating motion of the yoke 164 and jaw 166 as described above is repeated to move pre-formed straps downstream in the direction of arrow 34 along the anvil such that all of the holding bays 198*a*-198*i* contain a pre-formed strap, or a desired number of straps have been produced to dispense onto a bundle. Upon appropriate accumulation of pre-formed straps by the accumulating and dispensing mechanism 154, a pre-formed strap is retained within a last holding bay 198*i* defined as the cavity or space extending downstream from the downstream surface of a last dispensing tooth, e.g., tooth 196*i*. Further movement of the jaw toward the dispensing position dispenses the pre-formed strap retained in the last holding bay 198*i*, i.e., urges the strap to slide off of the anvil 176, to encircle the bundle 32 as it moves outwardly through the nozzle 16, usually without stopping. As the bundle 32 continues to extrude, it will expand such that the strap just dispensed around the bundle will tighten against it.

The dispenser 94*a* then reciprocates from the dispensing position to the holding position to capture the next-produced pre-formed strap in the first holding bay 198*a*, and back to the dispensing position, to dispense another pre-formed strap retained in the last holding bay 198*i* to encircle the bundle as it moves outwardly through the nozzle 16 at a location on the bundle a predetermined distance away from the previously dispensed strap. The reciprocating motion of the yoke 164 and jaw 166 continue to dispense the preformed straps retained within the holding bays 198*a*-198*i* of the jaw 166 sequentially to sufficiently strap the article, or bundle 32.

The predetermined distance is mainly dependent on the rate at which the bale is exiting the nozzle 16 and the rate at which the straps are dispensed. According to some embodiments, the rate at which the bale is exiting the nozzle can be adjusted to achieve a desired predetermined distance. In other embodiments, the rate at which the straps are dispensed can be adjusted to achieve a desired predetermined distance. In some embodiments, the predetermined distance is approximately six to eight inches.

Each of the dispensers 94*a*, 94*b*, 94*c*, 94*d* accumulate and dispense pre-formed straps 106 in unison such that each pre-formed strap encircling the nozzle is moved simultaneously an equal distance along the anvils 176 and each pre-formed strap to be dispensed is dispensed simultaneously around the bundle at the same location on the bundle.

Figure 11:
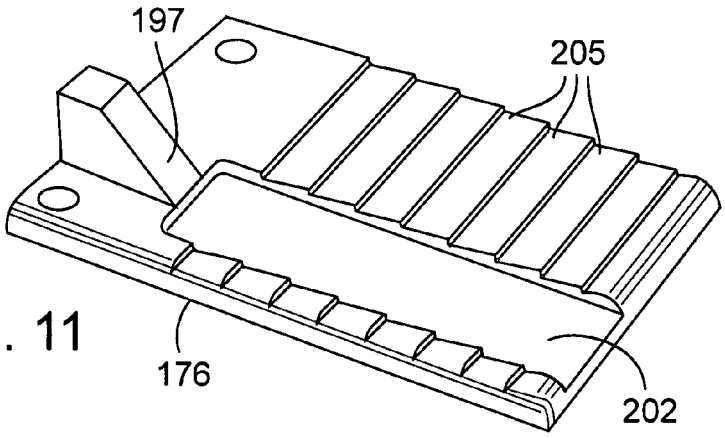
FIG. 11 is a perspective view of an anvil of a strapper of the present application.

As best shown in FIG. 11, in some embodiments, the anvil 176 can include a groove or "pocket" 202 configured to receive a portion of the teeth therein as the jaw reciprocates between the dispensing and holding positions. The pocket 202 assists in preventing wearing of the teeth 196 the jaw moves between the holding position and the dispensing position. In some embodiments, at least a portion of an outer surface of the anvil 176 can include teeth 205 adjacent to the pocket 202 to assist in keeping the straps 106 in place as the jaw 166 is moved from the dispensing position to the holding position.

Although the jaw of the illustrated embodiments includes nine teeth 196*a*-196*i*, it is recognized that in other embodiments, the jaw can include fewer than nine teeth or greater than nine teeth. Furthermore, the teeth of the jaw can be configured such that the holding bays are sized to retain only one strap or sized to contain one or more straps. For example, the holding bays 198*a*-198*i* of the jaw 166 shown in FIGS. 6-8 are sized to contain two straps with holding bay 198*b* and 198*c* in FIGS. 6 and 8, respectively, retaining two straps. Providing holding bays configured to retain more than one strap can be used to dispense multiple straps onto an article at a given location. Multiple straps applied at given locations can provide added retention where needed, such as may be required near the end of a bundle, or bale.

The strapper 24 of the present application can be a repositionable strapper for strapping non-expandable bales by applying strap directly onto the bales in a first strapping position and strapping expandable bales using pre-formed strap in a second strapping position. As shown in FIG. 10, the support arms 150 can include a slide or screw member coupled to the strapper frame 25 to facilitate movement of the frame between the first strapper position and the second strapper position (indicated in dashed lines). In some embodiments, the movement of the strapper is performed manually, in other embodiments, the strapper can be moved automatically using a drive mechanism, such as a motor or actuator.

In some embodiments, the dispensers are movably attached to the strapper frame 24 via one or more swing arms and are movable between an operating position and a non-operating position away from the operating position. In some embodiments, the dispensers can be pivotably, rotatably, slidably, or otherwise, attached to the strapper frame 24. In the illustrated embodiments, dispensers 94*a*, 94*d* and 94*b*, 94*c* are coupled to respective swing arms 206 and the swing arms are pivotably attached to the strapper frame 24. Referring to FIG. 10, dispensers 94*a*, 94*b* in the operating position are indicated in dashed line and dispensers in the non-operating position are indicated in solid line.

Generally, in some embodiments, when bales requiring strap to be formed directly onto the bales are to be strapped, the strapper is positioned in the first strapping position using the slide or screw member of the support arms 150. Because the dispensers are not necessary in this application, the dispensers can be repositioned, e.g., by being swung open via the swing arms 206 to place the dispensers away from the nozzle 16 in the non-operating position. In contrast, when bales conducive to the application of pre-formed straps, i.e., expandable bales, are to be strapped, the strapper is moved to the second strapping position using the slide or screw member of the support arms 150. In this application, the dispensers are swung inward via swing arms 206 to position the dispensers adjacent the nozzle 16 in the operable position to accumulate and dispense pre-formed straps around expandable bales.

Explaining further and citing one example of using the dual mode strapper of the present application to strap an expandable bale, a standard baling press may be operated to produce an expandable bale every 9 minutes. During production of an expandable bale, the dispensers of the present application can accumulate pre-formed straps in a jaw having nine holding bays in approximately 90 seconds. The pre-formed straps are then dispensed around the bale as it extrudes, which would typically take approximately 1 minute when using a non-stop eject ram. The baling press then requires about 30 seconds to begin producing another bale. Therefore, according to some embodiments of the strapper of the present application, an expandable bale can be sufficiently strapped into a desired shape in approximately 10.5 minutes. In contrast, strapping a bale into a desired shape using conventional techniques that require stopping the extruding action for applying strap around the bale can take about 18.5 minutes. Accordingly, more bales can be strapped in less time with the strapper described herein than with conventional strapping equipment.

In embodiments of the present application, the process of producing and accumulating a plurality of straps may occur concurrently with the production of an article, or of a bundle, in the bundle-producing machine 14. This is a benefit and advantage of the equipment of this application, in that pre-formed straps can be produced in a timely fashion, accumulated, and then dispensed onto an article, or bundle. In other words, the equipment and methods of the present application provide an efficient and economic approach for providing a plurality of pre-formed endless straps, accumulating them, and having them available to be dispensed quickly onto a bundle as the bundle is dispensed from the bundle-making equipment without the need to stop or slow the discharge of the bundle.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A dispenser for holding and dispensing pre-formed securing strap for securing an article comprising:

a yoke configured to reciprocate between a holding position and a dispensing position;

a jaw movably coupled to the yoke, the jaw including a plurality of holding bays configured to hold the pre-formed securing strap about an article-receiving region of the dispenser; and at least one spring positioned between and in contact with the yoke and jaw, the at least one spring configured to bias the jaw away from the yoke, wherein the jaw accumulates pre-formed securing strap when the yoke is moved from the dispensing position to the holding position and dispenses pre-formed securing strap onto the article when the yoke is moved from the holding position to the dispensing position.

2. The dispenser of claim 1, further comprising a driving mechanism coupled to the yoke to move the yoke between the holding position and the dispensing position.

3. The dispenser of claim 2, wherein the driving mechanism is a vertically oscillating cam rail engageable with the yoke for facilitating reciprocation of the yoke between the holding position and the dispensing position.

4. The dispenser of claim 2, wherein the driving mechanism is at least one of a motor, an actuated cylinder, linear actuator or a rotary actuator.

5. The dispenser of claim 1, comprising an anvil positioned proximate the article-receiving region for at least partially supporting the pre-formed securing strap.

6. The dispenser of claim 1, wherein the jaw comprises an elongate member having a plurality of tooth-shaped protrusions, and wherein the holding bays are defined between adjacent protrusions.

7. The dispenser of claim 6, wherein the protrusions comprise a generally concave surface for retaining pre-formed strap in the holding bays as the jaw moves from the holding position to the dispensing position.

8. The dispenser of claim 7, wherein the protrusions comprise an inclined surface generally opposing the generally concave surface, wherein contact between the inclined surface and pre-formed securing strap in a first holding bay urges the jaw to overcome a spring biasing force applied by the at least one spring and to move outward relative to the strap and longitudinally beyond the strap as the yoke moves from the dispensing position to the holding position such that the strap is retained in a second holding bay.

9. The dispenser of claim 7, wherein the jaw is movable to shift straps held in holding bays sequentially to the end of the jaw to discharge at least one pre-formed strap therefrom.

10. A dispenser for holding and dispensing pre-formed securing strap for securing an article comprising:

a yoke configured to reciprocate between a holding position and a dispensing position;

a jaw movably coupled to the yoke, the jaw including a plurality of holding bays configured to hold the pre-formed securing strap about an article-receiving region of the dispenser; and an anvil positioned proximate the article-receiving region for at least partially supporting the pre-formed securing strap, wherein the jaw accumulates pre-formed securing strap when the yoke is moved from the dispensing position to the holding position and dispenses pre-formed securing strap onto the article when the yoke is moved from the holding position to the dispensing position, and wherein the anvil includes an elongate recess, and wherein a portion of the jaw is extendable into the recess.

11. A dispenser for holding and dispensing pre-formed securing strap for securing an article comprising:

a yoke configured to reciprocate between a holding position and a dispensing position;

a jaw movably coupled to the yoke, the jaw including a plurality of holding bays configured to hold the pre-formed securing strap about an article-receiving region of the dispenser, wherein the jaw accumulates pre-formed securing strap when the yoke is moved from the dispensing position to the holding position and dispenses pre-formed securing strap onto the article when the yoke is moved from the holding position to the dispensing position, and wherein the jaw comprises an elongate member having a plurality of tooth-shaped protrusions, and wherein the holding bays are defined between adjacent protrusions, wherein the protrusions comprise a generally concave surface for retaining pre-formed strap in the holding bays as the jaw moves from the holding position to the dispensing position; and an anvil positioned proximate the article-receiving region for at least partially supporting the pre-formed securing strap, wherein the generally concave surfaces of the protrusions retain the pre-formed strap such that as the jaw moves from the holding position to the dispensing position, the pre-formed strap is urged along the anvil.

* * * * *